US006036479A

United States Patent [19]

Dubach et al.

[11] Patent Number: 6,036,479

[45] Date of Patent: Mar. 14, 2000

[54] TWO-STAGE PRESSURE ATOMIZER NOZZLE

[75] Inventors: Peter Dubach, Oberrohrdorf; Jonathan Lloyd, Dintikon, both of Switzerland; Thomas Sattelmayer, Erding, Germany; Christian Steinbach, Neuenhof, Switzerland

[73] Assignee: ABB Research Ltd., Zurich, Switzerland

[21] Appl. No.: 09/213,430

[22] Filed: Dec. 17, 1998

[30] Foreign Application Priority Data

Dec. 22, 1997 [EP] European Pat. Off. ..... 97811008

[51] Int. Cl.[7] ..... F23D 14/62

[52] U.S. Cl. ..... 431/351; 431/354; 239/403; 239/463

[58] Field of Search ..... 239/403, 463; 431/351, 285

[56] References Cited

FOREIGN PATENT DOCUMENTS

0704657A2 4/1996 European Pat. Off. .

0794383A2 9/1997 European Pat. Off. .

324589 9/1920 Germany .

*Primary Examiner*—Carroll Dority

*Attorney, Agent, or Firm*—Burns, Doane, Swecker & Mathis, L.L.P.

[57] ABSTRACT

The object of the invention is to provide a two-stage pressure atomizer nozzle for at least one liquid to be atomized, with which two-stage pressure atomizer nozzle improved liquid distribution in the exterior space of the pressure atomizer nozzle, in particular improved fuel distribution in a premix burner, can be achieved. To this end, the pressure atomizer nozzle has a nozzle head (4) connecting the outer and inner tubes (2, 3) to one another downstream. At least two separate turbulence and/or swirl chambers (9, 10, 11, 12) are arranged in the nozzle head (4). Each of these turbulence and/or swirl chambers (9, 10, 11, 12) is connected to the second feed passage (6) via at least one swirl passage (16), to the first feed passage (5) via at least one turbulence-generator passage (15) and to the exterior space (18) of the nozzle body (1) via a discharge opening (17).

11 Claims, 4 Drawing Sheets

FIG. 7
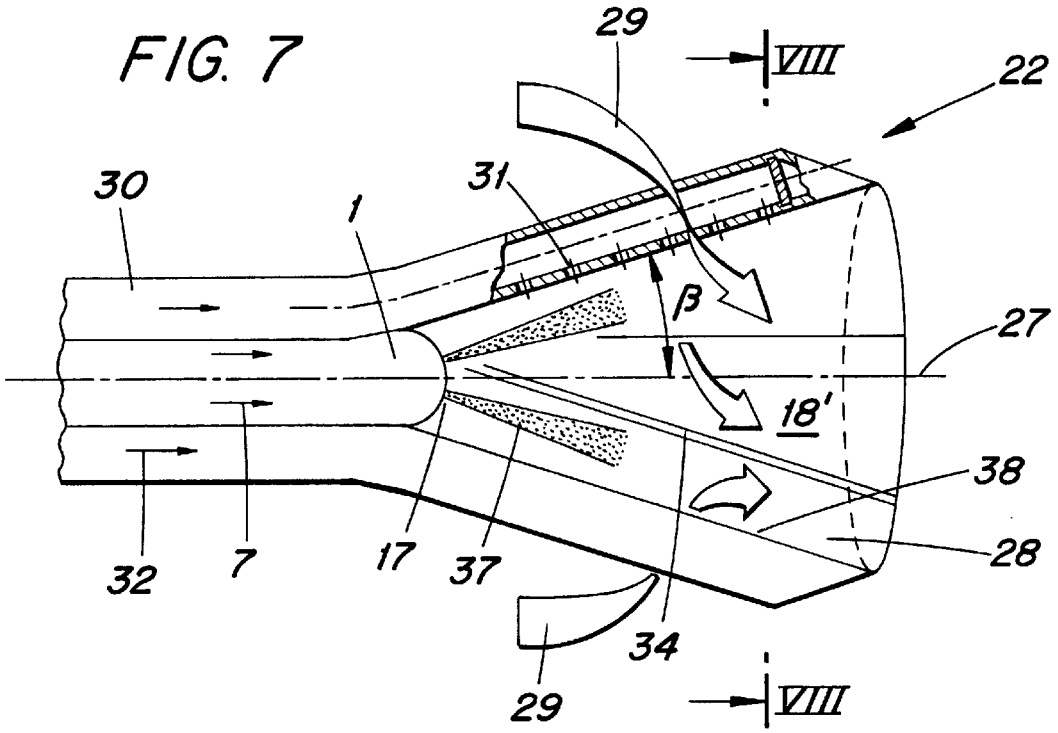
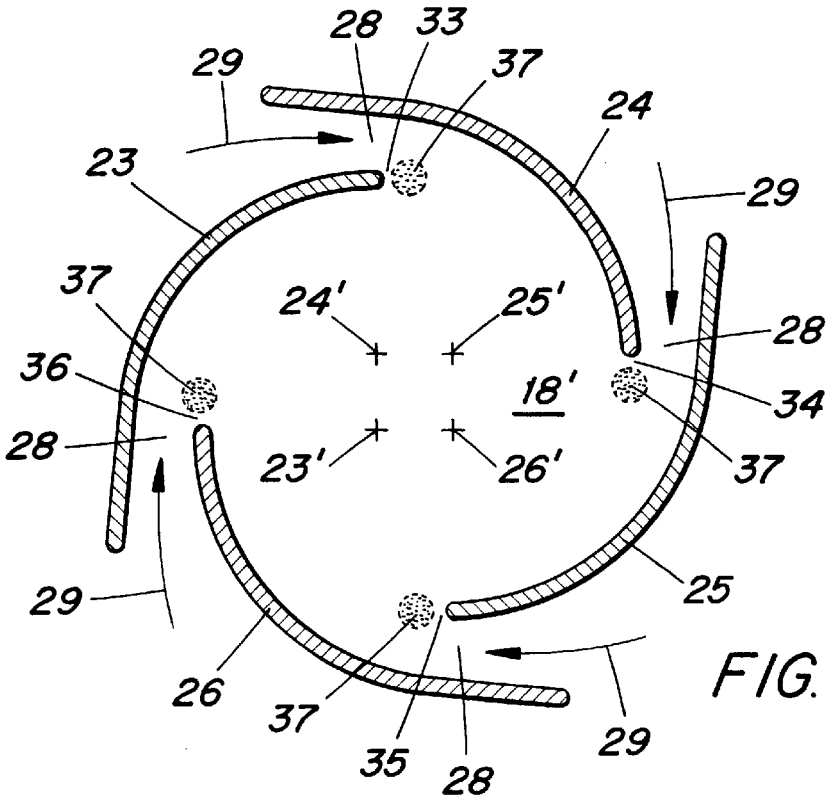
FIG. 8

TWO-STAGE PRESSURE ATOMIZER NOZZLE

BACKGROUND OF THE INVENTION

1. Field of the Invention

The invention relates to a two-stage pressure atomizer nozzle according to the preamble of claim 1, which is used, for example, in the premix burners of a gas-turbine plant.

2. Discussion of Background

With the increasing operating pressures of modern gas turbines, good distribution of the liquid fuel is becoming more and more of a problem. The reasons for this lie mainly in the increasing air density and in its impulse, which have a greater effect on the distribution of the fuel droplets.

EP 0 794 383 A2 has a two-stage pressure atomizer nozzle which enables the droplet spray to be adapted to the respective load conditions with regard to the atomization quality, the droplet size and the spray angle. Furthermore, the nozzle is distinguished by a simple type of construction requiring only a little space. To this end, it comprises a nozzle body having a turbulence and/or swirl chamber formed in the interior and connected to an exterior space via a nozzle bore. In addition, the pressure atomizer nozzle has at least one first passage for the liquid to be atomized, through which the latter can be fed under pressure. At least one further passage for a portion of the liquid to be atomized or for a second liquid to be atomized leads into the turbulence and/or swirl chamber, through which passage said portion of the liquid or the second liquid can be fed under pressure and with a swirl.

However, it has been found that, with increasing size of the burners, i.e. in the case of development as can clearly be seen when comparing FIGS. 12 and 17 of EP 0 794 383 A2, it becomes more difficult to ensure a uniform fuel distribution, even when using such a two-stage pressure atomizer nozzle. This can be attributed both to the overriding effect of the air on the distribution of the fuel droplets and to the increasing diameter of the burners or to the opening angle of their swirl generators.

The air which flows around the central fuel nozzle of such a large burner remains mainly in the region of the burner axis. If virtually the entire fuel quantity can be carried by this air, a center enriched with fuel results, in which case no large liquid-fuel quantities can pass into the outer region. Therefore the main vaporization of the fuel often already takes place before the fuel droplets reach the desired points of the burner, i.e. its outer regions. Thus high NOx emissions and a flashback of the flame may be caused in this case.

In order to also realize spraying of the fuel droplets into the outer regions of the burner, swirl nozzles having large jet angles are often used. Although such a swirl nozzle sprays in the correct direction, the small droplets produced by it do not have a sufficient impulse to transport the liquid fuel into the outer regions of the burner before the liquid fuel is vaporized or affected by the air. On the other hand, on account of the large spread during the initial distribution of the droplet sizes, large droplets may pass into the outer regions. However, these droplets are not vaporized and may finally impinge on the burner walls, with the risk of the flashback of the flame into the flow regions near the walls.

On the other hand, if a turbulence-intensified fuel jet, disclosed, for example, by EP 0 794 383 A2, is utilized, this fuel jet produces large droplets, having a sufficiently high impulse to pass through the air zone. However, these jets have a small spread angle and do not cause the droplets to be uniformly distributed in all directions.

SUMMARY OF THE INVENTION

Accordingly, one object of the invention, in attempting to avoid all of these disadvantages, is to provide a novel two-stage pressure atomizer nozzle for at least one liquid to be atomized, with which two-stage pressure atomizer nozzle improved liquid distribution in the exterior space of the pressure atomizer nozzle, in particular improved fuel distribution in a premix burner, can be achieved According to the invention, in a device according to the preamble of claim 1, this is achieved in that the pressure atomizer nozzle has a nozzle head connecting the outer and inner tubes to one another downstream, and at least two separate turbulence and/or swirl chambers are arranged in the nozzle head. Each of these turbulence and/or swirl chambers is connected to the second feed passage via at least one swirl passage, to the first feed passage via at least one turbulence-generator passage and to the exterior space via a discharge opening.

A multi-point injection system having at least two discharge openings is thereby produced, and this multi-point injection system permits a change in the atomization quality, the velocity and the direction of the liquid and thus permits an adaptation of the atomization and the distribution of the liquid to the respective load state. The discharge openings, which in each case receive only a portion of the total liquid mass flow, may be designed to be smaller than is possible in the case of a nozzle having only one discharge opening. At the same liquid mass flow, however, smaller discharge openings produce a substantially thinner liquid film in the swirl stage, as a result of which smaller droplets having a smaller depth of penetration are produced in the swirl stage. The range of use of the pressure atomizer nozzle is therefore advantageously also shifted toward part-load operation.

The nozzle body and the turbulence and/or swirl chambers each have a center axis. The center axes of the turbulence and/or swirl chambers are arranged so as to be radially offset from the center axis of the nozzle body, preferably at an angle to the center axis of the nozzle body in both the radial and tangential directions. In general, better liquid distribution over large cross-sectional areas can thereby be achieved. In the design of the pressure atomizer nozzle, the radial offset and the angular setting of the center axes of the turbulence and/or swirl chambers relative to the center axis of the nozzle body are adapted to the desired spraying directions of the forming spray.

A cover lid accommodating the at least one turbulence-generator passage is arranged between the first feed passage and each of the turbulence and/or swirl chambers. Relatively simple production of the turbulence and/or swirl chambers is thereby ensured, the turbulence and/or swirl chambers being made in the nozzle head by milling or drilling, for example, and being covered upstream by means of the cover lids to be fitted subsequently. Increased turbulence of the liquid used and thus a finer spray can be achieved by the arrangement of the turbulence-generator passage in the outer region of the respective cover lid.

In addition, the first feed passage leads into a first plenum formed upstream of the cover lid, whereas a second, encircling plenum is formed between the second feed passage and the swirl passages connected to the latter. As a result, all the turbulence and/or swirl chambers may advantageously be provided with only one first feed line and only one second feed line, which makes possible a nozzle body of very compact design. In an especially advantageous manner, the first plenum has a larger cross section than the feed passage admitting liquid to it, as a result of which a more uniform admission of liquid to the turbulence and/or swirl chambers is achieved. With the same advantage, the cross sections of the two plenums are also designed to be larger than the sum of the cross sections of the turbulence-generator and/or swirl passages to which they admit liquid.

It is especially expedient if all the turbulence and/or swirl chambers are designed to be the same size. In this way, uniform liquid distribution in the exterior space of the nozzle body can be ensured.

In addition, the nozzle head is of hemispherical design in its downstream region. As a result, the development of a so-called eddying zone in the wake of the nozzle and thus any flow separations associated with droplet deposits can be counteracted. Recesses are made in this hemispherical contour of the nozzle head, each discharge opening leading into one of the recesses, and each recess being arranged at right angles to the discharge opening leading into it. The liquid distribution in the exterior space of the nozzle body can be further improved on account of this configuration of the discharge region.

In an embodiment of the invention, the nozzle body is connected to a premix burner in such a way that its exterior space is at the same time an interior space of the premix burner. The premix burner essentially comprises four hollow sectional cone bodies which are positioned one upon the other in the direction of flow and have a constant cone half angle β in the direction of flow. The longitudinal symmetry axes of the sectional cone bodies run radially offset from one another, so that four fluidically opposed, tangential air-inlet slots for a combustion-air flow are formed. In this case, the nozzle body is arranged in the hollow conical interior space, formed by the conical sectional bodies, of the premix burner. A wake zone of the sectional cone body is formed downstream of each sectional cone body. Arranged in the nozzle head of the pressure atomizer nozzle are four turbulence and/or swirl chambers, the discharge openings of which are oriented to the wake zone of the respectively adjacent sectional cone body.

In this embodiment of the invention, the fuel mass flow is split up into four equal partial flows via the turbulence and/or swirl chambers. Since the turbulence and/or swirl chambers each have a smaller discharge opening than can be realized in the case of only one turbulence and/or swirl chamber having a single discharge opening, a thinner fuel spray can therefore be produced. This results in smaller fuel droplets, which have a smaller depth of penetration into the burner interior space and vaporize considerably quicker, i.e. before impinging on the inner wall of the sectional cone bodies. As a result of the orientation of the discharge openings of the turbulence and/or swirl chambers to the wake zones of the sectional cone bodies, the fuel droplets are subjected to lower aerodynamic forces and can therefore penetrate more effectively into the combustion air in the radial direction. Finally, uniform distribution of liquid-fuel vapor and thus improved combustion are thereby made possible at the outlet of the burner.

Such a pressure atomizer nozzle or the burner equipped with it can be adapted to the full-load or part-load demand by simple control of the fuel feed, i.e. by switching over from turbulence operation to the swirl operation or mixed operation. On account of the wide variety of possible changes between swirl-intensified and turbulence-intensified spray mists, the solution can be applied under most machine and output conditions.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of a two-stage pressure atomizer nozzle, wherein:

FIG. 7 shows a premix burner with integrated pressure atomizer nozzle;

FIG. 8 shows a section VIII—VIII through the premix burner according to FIG. 7.

Only the elements essential for the understanding of the invention are shown. Not shown are, for example, the combustion chamber accommodating the premix burner and the gas turbine connected to the combustion chamber. The direction of flow of the working media is designated by arrows.

DESCRIPTION OF THE PREFERRED EMBODIMENTS

Figure 1:
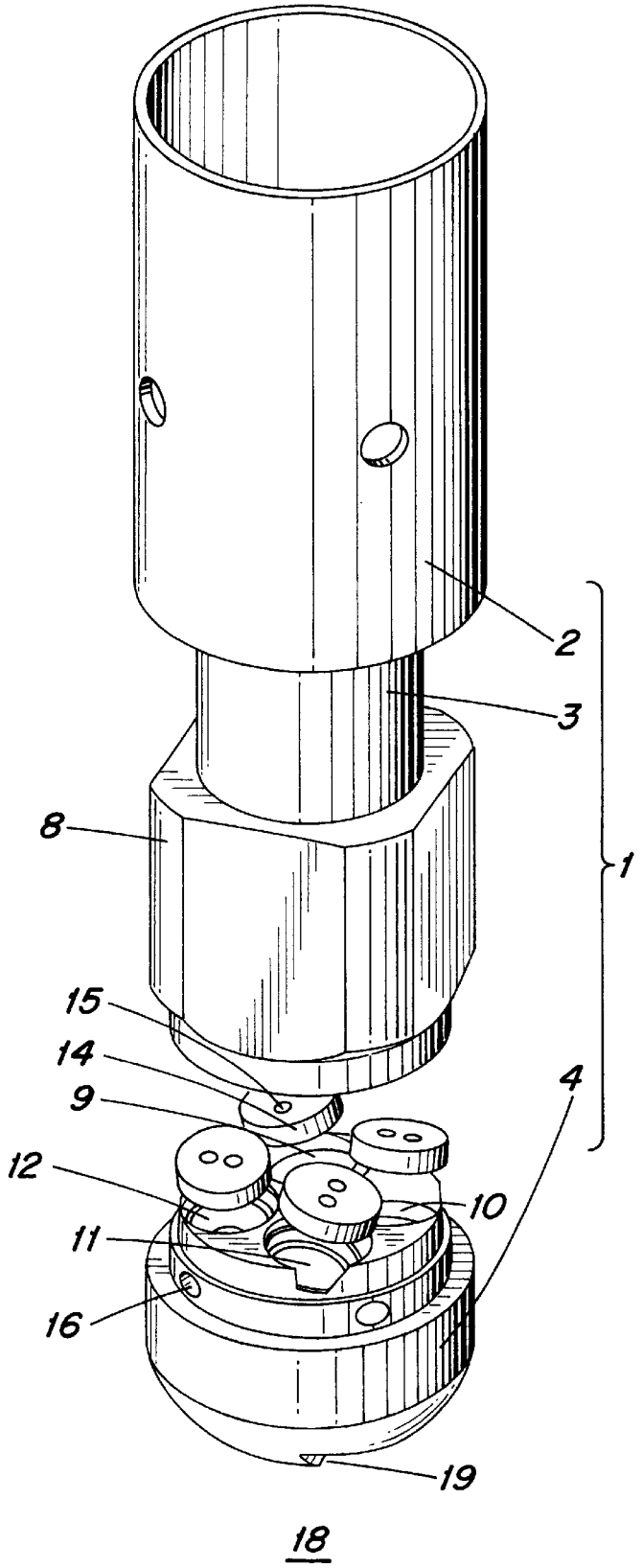
FIG. 1 shows the pressure atomizer nozzle in perspective representation.
Figure 2:
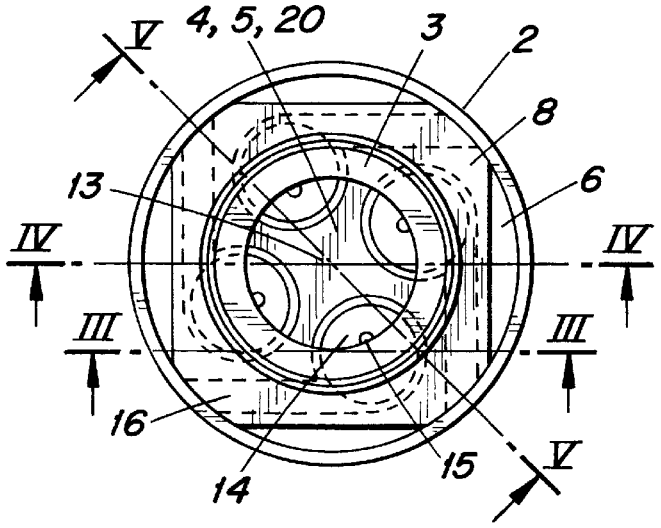
FIG. 2 shows a plan view of the pressure atomizer nozzle according to FIG. 1.

Referring now to the drawings, wherein like reference numerals designate identical or corresponding parts throughout the several views, the pressure atomizer nozzle has a nozzle body 1, which consists of an outer tube 2 and an inner tube 3 and is closed off downstream by a nozzle head 4 (FIG. 1, FIG. 2). A first feed passage 5 is formed in the inner tube 3 and a second feed passage 6 is formed between the outer tube 2 and the inner tube 3 for at least one liquid fuel 7. Upstream of the nozzle head 4, a spacer 8 used for stabilization is arranged between the inner tube 3 and the outer tube 2. The nozzle head 4 accommodates four turbulence and/or swirl chambers 9, 10, 11, 12 of the same size. The turbulence and/or swirl chambers 9, 10, 11, 12 may of course also have a different size (not shown) in appropriate service conditions, although in this case care has to be taken that symmetrical spraying is always effected.

Figure 3:
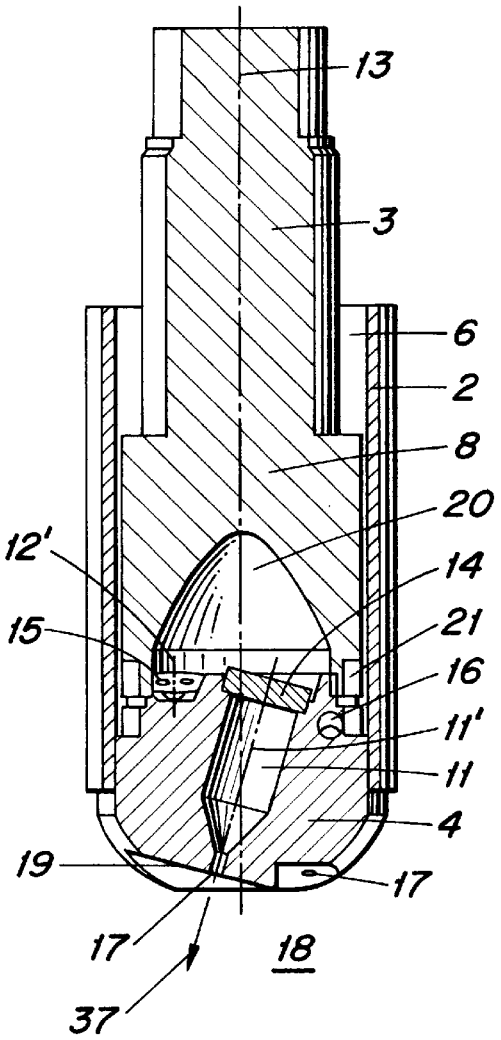
FIG. 3 shows a reduced section through the pressure atomizer nozzle along line III—III in FIG. 2.
Figure 4:
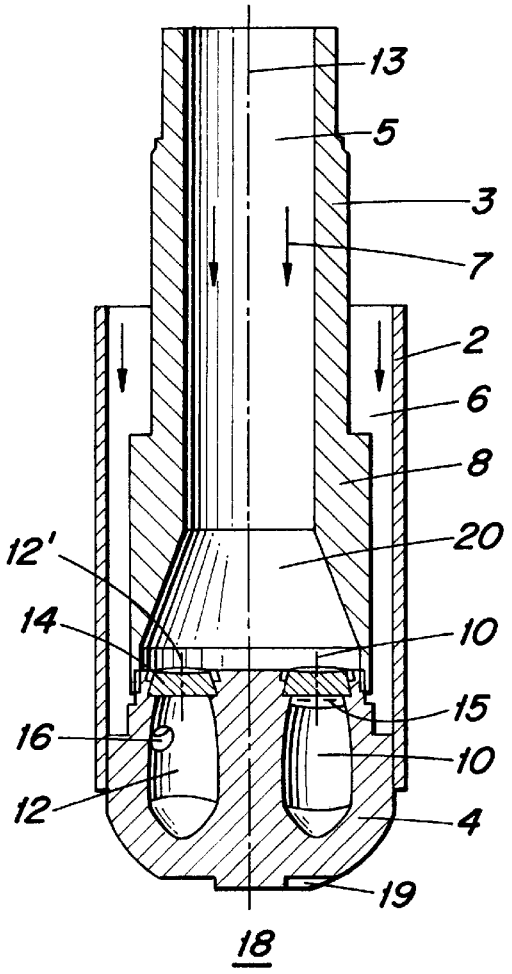
FIG. 4 shows a reduced section through the pressure atomizer nozzle along line IV—IV in FIG. 2.
Figure 5:
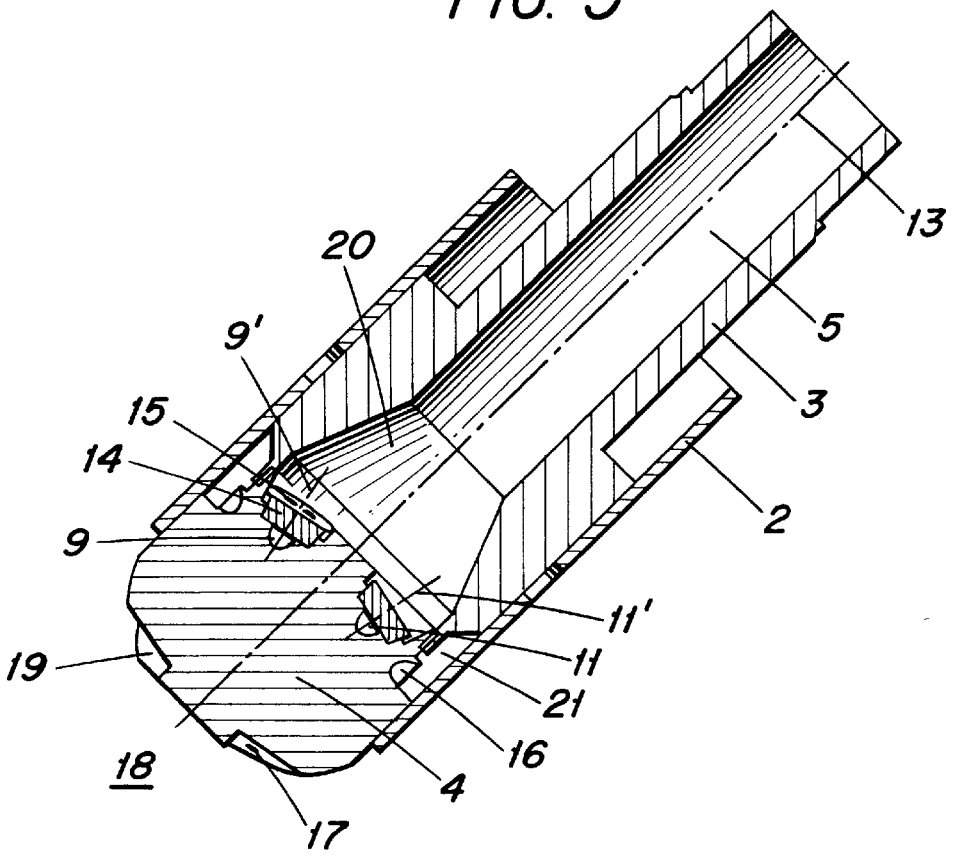
FIG. 5 shows a reduced section through the pressure atomizer nozzle along line V—V in FIG. 2.

Both the turbulence and/or swirl chambers 9, 10, 11, 12 as well as the nozzle body 1 each have a center axis 9', 10', 11', 12', 13, the center axes 9', 10', 11', 12' of the turbulence and/or swirl chambers 9, 10, 11, 12 being arranged at an angle to the center axis 13 of the nozzle body 1 in both the radial and tangential directions. In this case, an imaginary plane through the center axis 13 of the nozzle body 1 intersects the imaginary planes through the center axes 9', 10', 11', 12' of the turbulence and/or swirl chambers 9, 10, 11, 12 in the interior of the nozzle body 4 at both a radial and a tangential angle (FIG. 3). The position of the turbulence and/or swirl chambers 9, 10, 11, 12 in the interior of the nozzle head 4 is also shown in FIGS. 4 and 5 in accordance with the sections designated in FIG. 2. In an actual pressure atomizer nozzle, the angular setting of the center axes 9', 10', 11', 12' relative to the center axis 13 of the nozzle body 1 depends on the desired spraying directions of the forming fuel spray 37. In accordance with the actual service conditions of the pressure atomizer nozzle, the center axes 9', 10', 11', 12' of the turbulence and/or swirl chambers 9, 10, 11, 12 may therefore also be arranged so as to be offset from the center axis 13 of the nozzle body 1 merely in a position parallel to said center axis 13.

Figure 6:
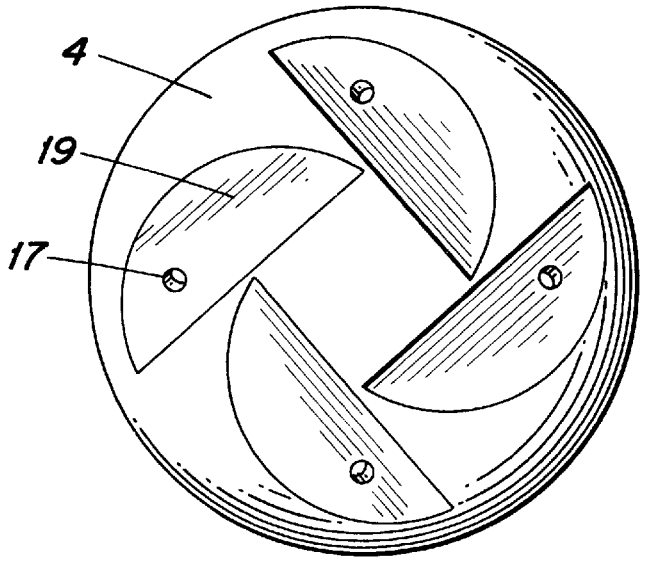
FIG. 6 shows a view of the pressure atomizer nozzle according to FIG. 1 but from below.

Each of the turbulence and/or swirl chambers 9, 10, 11, 12 is closed off from the first feed passage 5 by means of a cover lid 14. Arranged in the outer region of each cover lid 14 are two turbulence-generator passages 15, which connect the respective turbulence and/or swirl chamber 9, 10, 11, 12 to the first feed passage 5. In addition, the turbulence and/or swirl chambers 9, 10. 11, 12 are connected to the second feed passage 6 in each case via a swirl passage 16 (FIG. 1, FIG. 2) and to an exterior space 18 in each case via a discharge opening 17 (FIG. 3, FIG. 6). The nozzle body 1 therefore has four discharge openings 17, which in each case let through only one quarter of the entire fuel mass flow. To this end, they are designed to be smaller than a single-orifice nozzle, which receives the entire mass flow, and produce smaller droplets at similar liquid-fuel pressures.

The nozzle head 4 is of hemispherical design in its downstream region, each discharge opening 17 leading into a recess 19 made in the hemispherical contour of the nozzle head 4, and each recess 19 being arranged at right angles to the discharge opening 17 leading into it in each case. Any other fluidically favorable design of the downstream region of the nozzle head 4, for example an elliptical shape, is of course also suitable.

Formed upstream of the cover lids 14 is a first plenum 20, into which the first feed passage 5 leads. The first plenum 20 has a larger cross section than the feed passage 5 admitting liquid to it. A second, encircling plenum 21 is formed between the second feed passage 6 and the swirl passages 16 connected to the latter. The cross sections of the two plenums 20, 21 are designed to be larger than the sum of the cross sections of the turbulence-generator passages 15 and swirl passages 16 respectively to which they admit liquid. A compact nozzle body 1, which consists of four sectional nozzles having in each case a turbulence stage and a swirl stage and having a common geometry and a uniform diameter, is therefore realized.

The liquid fuel 7 is fed to the nozzle body 1 via lines (not shown) in a manner known per se, as shown and described, for example, in EP 0 794 383 A2.

During the operation of the turbulence stage, the liquid fuel 7 passes via the first feed passage 7 into the first plenum 20. From there, it is directed as a turbulent flow through the turbulence-generator passages 15 of the cover lids 14 into the respective turbulence and/or swirl chamber 9, 10, 11, 12. On account of the enlarged cross section, compared with the first feed passage 5, of the first plenum 20, a relatively uniform admission of liquid to the turbulence and/or swirl chambers 9, 10, 11, 12 is achieved. The liquid fuel 7 is then sprayed into the exterior space 18 via the discharge openings 17 of the turbulence and/or swirl chambers 9, 10, 11, 12. In the process, the turbulence and/or swirl chambers 9, 10, 11, 12 produce four equal-sized fuel sprays 37 having an improved droplet distribution. Due to the fact that the liquid fuel 7 is sprayed into the exterior space 18 at right angles to the respective recess 19, circular fuel sprays 37 are formed, which further improves the fuel distribution.

In contrast, liquid fuel 7 is admitted to the swirl stage via the second feed passage 6. The liquid fuel 7 passes first of all into the second plenum 21 and from there is finally uniformly apportioned among the turbulence and/or swirl chambers 9, 10, 11, 12 via the tangential swirl passages 16.

Of course, in the part-load range, a combination of partly turbulence-intensified operation and partial swirl operation is also possible. In this case, the arrangement of the turbulence-generator passages 15 in the outer region of the cover lids 14, i.e. close to the side walls of the turbulence and/or swirl chambers 9, 10, 11, 12, helps to uniformly form the liquid-fuel full conical spray (not shown) and thus to further improve the distribution of the fuel droplets.

In a second exemplary embodiment of the invention, the nozzle body 1 is connected to a premix burner 22 in such a way that the exterior space 18 of the nozzle body 1 is at the same time an interior space 18' of the premix burner 22 (FIG. 7). The premix burner 22 is a conical structure and essentially comprises four hollow sectional cone bodies 23, 24, 25, 26 which are positioned one upon the other and have a constant cone half angle β to the burner axis 27 in the direction of flow. The nozzle body 1 is arranged in the narrowest cross section of the hollow conical interior space 18', formed by the sectional cone bodies 23, 24, 25, 26, of the premix burner 22. As with FIGS. 1 to 6, the nozzle body 1 has four turbulence and/or swirl chambers 9, 10, 10 11, 12 with one discharge opening 17 each.

The sectional cone bodies 23, 24, 25, 26 each have longitudinal symmetry axes 23', 24', 25', 26' respectively. The latter run radially offset from one another, so that four fluidically opposed, tangential air-inlet slots 28 for a combustion-air mass flow 29 are formed (FIG. 8). In addition, the sectional cone bodies 23, 24, 25, 26 each have a feed line 30 along the air-inlet slots 28, and these feed lines 30 are provided on the longitudinal side with openings 33 for the feeding of a gaseous fuel 32 into the interior space 18' of the premix burner 22 (FIG. 7). If required, this fuel 32 is admixed with the combustion-air mass flow 29 introduced into the interior space 18' through the tangential air-inlet slots 28. Mixed operation of the premix burner 22 via the pressure atomizer nozzle and the feed lines 30 is possible.

During operation of the premix burner 22 via the pressure atomizer nozzle, a wake zone 33, 34, 35, 36, as a function of both the material thickness of the sectional cone bodies 23, 24, 25, 26 of the premix burner 22 and the flow velocity of the combustion-air mass flows 29, inevitably forms downstream of each sectional cone body 23, 24, 25, 26, in which wake zone 33, 34, 35, 36 markedly lower aerodynamic forces prevail than in the adjacent regions of the interior space 18'. Each of the four discharge openings 17 of the turbulence and/or swirl chambers 9, 10, 11, 12 is oriented to one of the wake zones 33, 34, 35, 36 of the sectional cone bodies 23, 24, 25, 26. As a result, the liquid fuel 7 is sprayed in the form of four separate fuel sprays 37 via the discharge openings 17 into the interior space 18' of the premix burner 22, more precisely into the wake zones 33, 34, 35, 36 of the sectional cone bodies 23, 24, 25, 26. As a result of this orientation of the fuel sprays 37, the fuel droplets are subjected to lower aerodynamic forces and are accordingly radially intermixed more effectively with the combustion-air mass flows 29. The improved premixing leads to a uniformly prepared fuel mixture at the burner end and thus to improved combustion with markedly lower NOx values.

At full load of a gas turbine (not shown) connected to a combustion chamber, the pressure atomizer nozzles of each premix burner 22 admitting the fuel mixture to the combustion chamber are operated virtually entirely during their turbulence stage. Fuel sprays 37 having small angles, oriented to the burner inner walls 38, and having high droplet impulses are thereby produced. These fuel droplets penetrate into the air zone surrounding them and formed by the combustion-air mass flow 29 and thus reach the outer regions of the interior space 18' of the premix burner 22 in a large number. Finally, in this way, a uniform fuel vapor profile can be formed at the burner outlet.

In general, at part load, the combustion-air mass flow 29 and thus also its impulse are reduced, which gives rise to the need for a smaller fuel mass flow, a lower spray impulse and therefore smaller fuel droplets. In this operating state of the gas turbine, therefore, the admission of liquid to the respective swirl stage of the pressure atomizer nozzles takes place to a greater extent than to the turbulence stage. An increasing swirl ratio gradually and automatically reduces the mass flow of the liquid fuel 7. In addition, since the swirl stage realizes a smaller mass flow than the turbulence stage, the fuel quantity of the liquid fuel 7 drops accordingly. In order to prevent an increase in the droplet size and thus the impingement of the fuel droplets on the burner inner walls 38, a changeover is effected from the turbulence stage toward the swirl stage. On the other hand, when the load of the gas turbine drops, i.e. when the effect of the combustion-air mass flow 29 decreases further, a further reduction in the droplet size of the liquid fuel 7 is achieved by the changeover to full swirl operation.

The premix burner, in accordance with EP 0 704 657 A2, may of course also comprise a swirl generator and a mixing tube adjoining downstream, in which case the swirl generator essentially corresponds to the premix burner 22 described above, or a solution for double-cone burners, i.e. for a premix burner having two sectional cone bodies, may also be realized (not shown). Likewise, the premix burner may be of non-conical design and/or may consist of a number of blades arranged in a circle (likewise not shown).

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A two-stage pressure atomizer nozzle for at least one liquid to be atomized, having a nozzle body consisting of an outer tube and an inner tube, a first feed passage being formed in the inner tube and a second feed passage being formed between the outer tube and the inner tube, both feed passages leading into a turbulence and/or swirl chamber, and the latter being connected to an exterior space via a discharge opening, wherein a) the nozzle body has a nozzle head connecting the outer and inner tubes to one another downstream, b) at least two separate turbulence and/or swirl chambers are arranged in the nozzle head, c) each of the turbulence and/or swirl chambers is connected to the second feed passage via at least one swirl passage, to the first feed passage via at least one turbulence generator passage and to the exterior space via a discharge opening.

2. The two-stage pressure atomizer nozzle as claimed in claim 1, wherein the nozzle body and the turbulence and/or swirl chambers each have a center axis, and the center axes of the turbulence and/or swirl chambers are arranged so as to be radially offset from the center axis of the nozzle body, preferably at an angle to the center axis of the nozzle body in both the radial and tangential directions.

3. The two-stage pressure atomizer nozzle as claimed in claim 2, wherein a cover lid accommodating the at least one turbulence-generator passage is arranged between each turbulence and/or swirl chamber and the first feed passage.

4. The two-stage pressure atomizer nozzle as claimed in claim 3, wherein the at least one turbulence-generator passage is arranged in the outer region of the respective cover lid.

5. The two-stage pressure atomizer nozzle as claimed in claim 3, wherein the first feed passage leads into a first plenum formed upstream of the cover lid, and a second, encircling plenum is formed between the second feed passage and the swirl passages connected to the latter.

6. The two-stage pressure atomizer nozzle as claimed in claim 5, wherein the first plenum has a larger cross section than the feed passage admitting liquid to it.

7. The two-stage pressure atomizer nozzle as claimed in claim 5, wherein the cross section of the first plenum is larger than the sum of the cross sections of the turbulence-generator passages, and the cross section of the second plenum is larger than the sum of the cross sections of the swirl passages.

8. The two-stage pressure atomizer nozzle as claimed in claim 6, wherein all the turbulence and/or swirl chambers are designed to be the same size.

9. The two-stage pressure atomizer nozzle as claimed in claim 8, wherein the nozzle head is of hemispherical design in its downstream region, and a number of recesses corresponding to the number of discharge openings are made in the hemispherical contour of the nozzle head, each discharge opening leading into one of the recesses, and each recess being arranged at right angles to the discharge opening leading into it in each case.

10. The two-stage pressure atomizer nozzle as claimed in claim 1, wherein the nozzle body is connected to a premix burner, and the exterior space of the nozzle body is at the same time an interior space of the premix burner.

11. The two-stage pressure atomizer nozzle as claimed in claim 10, wherein a) four turbulence and/or swirl chambers are arranged in the nozzle head, b) the premix burner essentially comprises four hollow sectional cone bodies which are positioned one upon the other in the direction of flow and have a constant cone half angle $\beta$ in the direction of flow and whose longitudinal symmetry axes run radially offset from one another, so that four fluidically opposed, tangential air-inlet slots for a combustion-air mass flow are formed, c) the nozzle body is arranged in the hollow conical interior space, formed by the sectional cone bodies of the premix burner, d) a wake zone is formed downstream of each sectional cone body, and e) each discharge opening of the turbulence and/or swirl chambers is oriented to the wake zone of the sectional cone body adjacent to it.

* * * * *